United States Patent [19]

Giragosian

[11] 4,449,311

[45] May 22, 1984

[54] REVERSIBLE MAGAZINE LATCH SYSTEM FOR PISTOLS

[76] Inventor: Paul S. Giragosian, 66 Lake St., Arlington, Mass. 02174

[21] Appl. No.: 423,323

[22] Filed: Sep. 24, 1982

[51] Int. Cl.[3] ..... F41C 25/06

[52] U.S. Cl. ..... 42/7

[58] Field of Search ..... 42/7

[56] References Cited

U.S. PATENT DOCUMENTS

| | | | |
|---|---|---|---|
| 984,519 | 2/1911 | Browning | 42/7 |
| 1,397,109 | 11/1921 | Pedersen | 42/7 |
| 1,405,685 | 2/1922 | Hammond | 42/7 |
| 4,236,337 | 12/1980 | Beretta | 42/7 |
| 4,245,418 | 1/1981 | Kennedy | 42/7 |
| 4,326,353 | 4/1982 | Ludwig | 42/7 |

FOREIGN PATENT DOCUMENTS

| | | | |
|---|---|---|---|
| 672094 | 2/1939 | Fed. Rep. of Germany | 42/7 |

*Primary Examiner*—Charles T. Jordan

[57] ABSTRACT

A reversible magazine latch system for pistols having a grip portion in which there is provided a cavity for a magazine, the system comprising a latch seat extending through the pistol, a magazine latch assembly adapted for disposition in and retention by the seat in selectively a right or left hand orientation, and a magazine adapted to be engaged by the latch assembly.

6 Claims, 4 Drawing Figures

REVERSIBLE MAGAZINE LATCH SYSTEM FOR PISTOLS

BACKGROUND OF THE INVENTION

1. Field of the Invention

The invention relates to firearms and is directed more particularly to a reversible magazine latch system for pistols.

2. Description of the Prior Art

In the field of automatic firearms, and particularly pistols, it is common for the grip portion of the pistol to define a cavity for a magazine, and it is known to employ latches for locking and unlocking the magazine in the cavity. Among the known latches, there is a sliding type, which is seated and guided transversely, with respect to the cavity receiving the magazine, so as to engage a slot provided on a surface of the magazine. Generally, sliding latches have a unidirectional and irreversible use, in that they may be used either from left to right only, in the case of pistols adapted for right-handed individuals, or from right to left only, in the case of pistols adapted for left-handed individuals. Such limitation is an inconvenience when pistons are used by persons with the opposite hand.

U.S. Pat. No. 4,236,337 issued Dec. 2, 1980, sought to remedy the problem by providing a reversible sliding magazine latch for pistols. However, removal and insertion of the '337 latch device require placing the device at an oblique angle relative to the latch seat, which can cause some difficulty in realizing the benefits of the invention.

SUMMARY OF THE INVENTION

It is, therefore an object of the present invention to provide a latch system for magazines of pistols wherein the mounting and the use of the latch are reversible, enabling the pistol to be used as a right-handed latch pistol and as a left-handed latch pistol.

Another object of the invention is to provide a reversible latch system in which a latch assembly is easily changed from one side to the other of the pistol, and in which the latch assembly is inserted in the latch seat substantially axially of the latch seat.

With the above and other objects in view, as will hereinafter appear, a feature of the present invention is the provision of a reversible magazine latch system for pistols having a grip portion in which there is provided a cavity for a magazine, the system comprising a latch seat disposed in the pistol, a magazine latch assembly adapted for disposition in and retention by the seat, and a magazine adapted to be engaged by the latch, the seat comprising an opening extending through the pistol and adapted to receive the latch assembly at either end of the opening and retain the latch assembly therein, the magazine having two lateral slots, a selected one of the slots being accessible to the latch assembly when the magazine is disposed in the cavity, the magazine latch assembly comprising a body portion having a first head portion on a first end thereof and a chamber therein, a second head portion threadedly connected to the body portion at a second end of the body portion, a latch portion movably disposed in the chambers, and detent means extending from the latch portion and through an opening in the body portion, the detent means being adapted to engage the selected one of the magazine slots.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
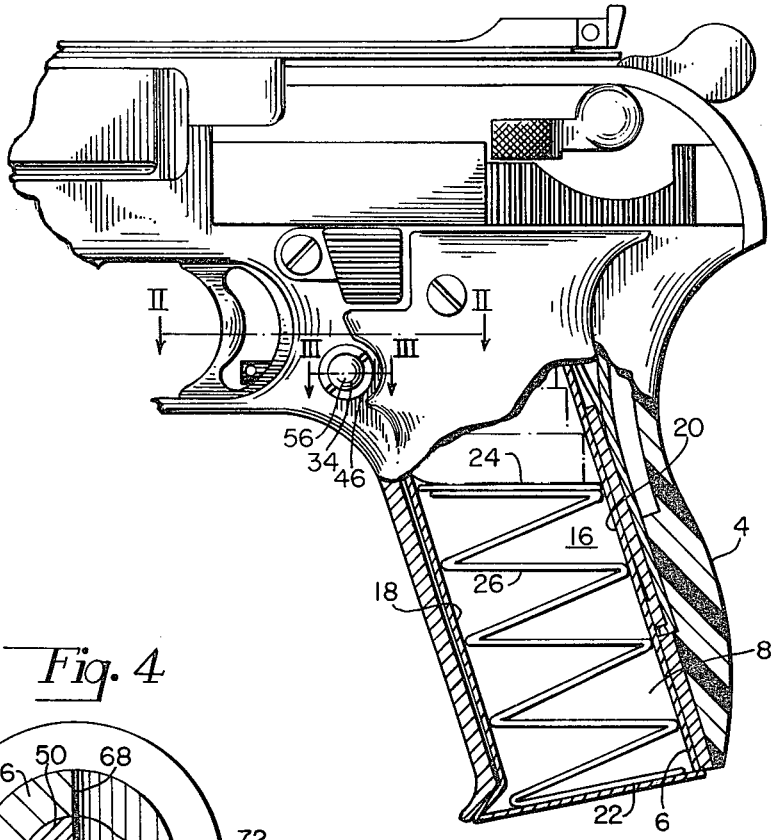
FIG. 1 is a side elevational view of a portion of a pistol showing an illustrative disposition of the invention.
Figure 4:
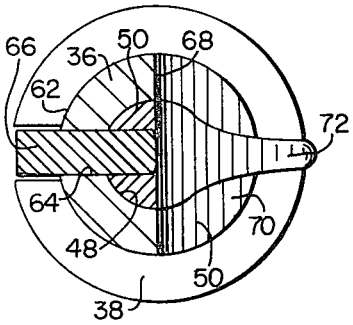
FIG. 4 is a sectional view taken along line IV—IV of FIG. 3, but showing elements of the invention in an alternative position.

Referring to the drawings, it will be seen that the illustrative system is adapted for use in conjunction with a pistol having a grip portion 4 in which there is provided a cavity 6 for a magazine 8.

The magazine 8 is provided with two lateral slots 10, 12, one on each side of the magazine. The slots 10, 12 are adapted to receive a latch means, as will be fully described herein below. The magazine 8 comprises spaced side walls 14, 16, a rounded front wall 18, a back wall 20, a base portion 22, and an internal follower 24, biased by a spring 26. The magazine is adapted to retain a plurality of cartridges and facilitate feeding of the cartridges into a cartridge chamber in the barrel of the pistol.

The grip portion 4 of the pistol 2 is provided with a latch seat 28 having first and second enlarged areas 30, 32 at either end thereof, respectively. The latch seat 28 is adapted to receive a magazine latch assembly 34. The magazine latch assembly 34 includes a generally tubular body portion 36 having at a first end thereof a first head portion 38 having a slot 40 therein. At a second end thereof, the body portion 36 is provided with internal threads 42 adapted to receive a threaded stem portion 44 of a second head portion 46 adapted to be received by the first enlarged area 30.

The body portion 36 and the stem portion 44, when threadedly connected, define a chamber 48 in which is disposed a latch portion 50. A shank 52 extends from a first end 53 of the latch portion 50 and through an axial opening 54 in the stem portion 44 of the second head portion 46, the shank 52 having a lock button 56 on a free end thereof. At a second end 57 of the latch portion 50, a coil spring 58 is disposed between the latch portion 50 and an internal end wall 60 of the body portion 36, to bias the lock button 56 outwardly, as shown in FIG. 2.

A forward wall 62 of the body portion 36 is provided with a slot 64 in which is disposed a free end of a pin 66 mounted in the latch portion 50, the slot 64 and pin 66 allowing limited movement of the latch portion 50 in the chamber 48.

Opposite the slot 64 there is an opening 68 in the body portion 36 adapted to receive the afore-mentioned magazine forward wall 18. The latch portion 50 includes a concave contour 70 generally complementary to the magazine wall 18 but including a detent means 72 adapted to engage one of the magazine slots 10, 12.

Figure 2:
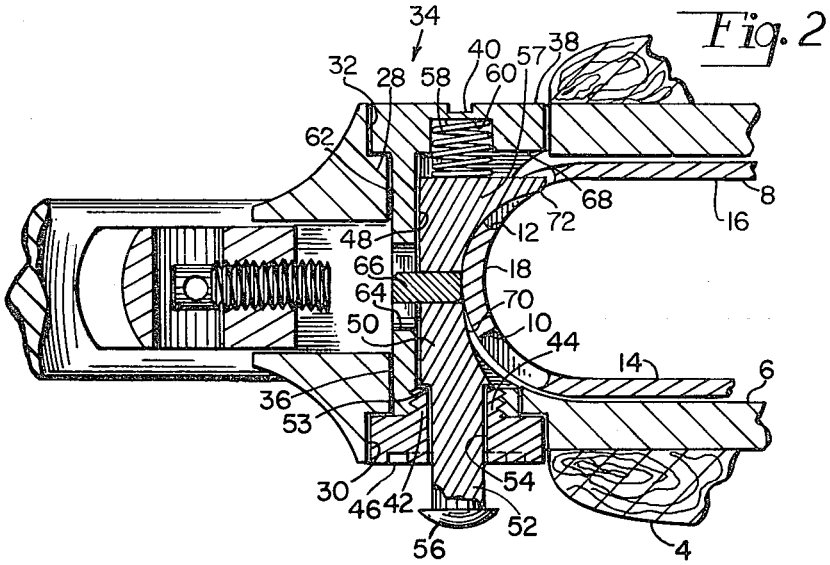
FIG. 2 is a sectional view of the invention, taken along line II—II of FIG. 1.

Referring to FIG. 2, it will be seen that in the illustrated position, the lock button 56 is biased to an outward position by the coil spring 58 and that the detent 72 is disposed in the magazine slot 12 to securely lock the magazine 8 in the cavity 6 of the grip portion 4 of the pistol 2.

Figure 3:
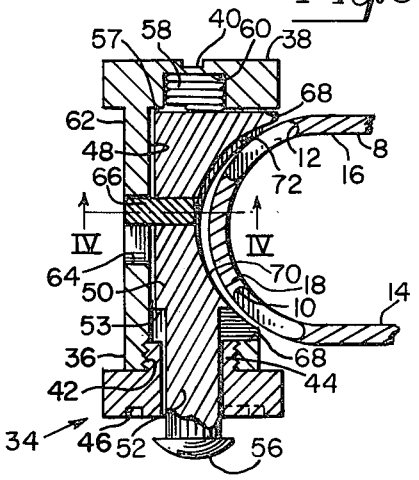
FIG. 3 is a sectional view illustrative of an embodiment of the invention, taken along line III—III of FIG. 1.

To release the magazine 8, an operator depresses the lock button 56, against the bias of the spring 58, causing the latch portion 50 to move in the chamber 48, with the pin 66 moving in the slot 64 until the pin abuts an end of the slot, at which point the detent means 72 will be removed from the slot 12 (FIG. 3) permitting withdrawal of the magazine 8 from the cavity 6. After insertion of a new magazine, the operator releases the lock button 56, permitting the detent means 72 to be moved by the spring 58 into engagement with the magazine slot 12.

To change the latch assembly from a right hand orientation, wherein the lock button is on the left (FIG. 1) to a left hand orientation, wherein the lock button is on the right, an operator depresses the lock button 56 to release the magazine 8, and then releases the lock button 56 and separates the body portion 36 from the stem portion 44, by turning the first head portion 38, as by insertion of a coin, or the like, in the groove 40 and disengaging the threaded portions of the body portion 36 and the stem portion 44. After separation of the threaded elements 36, 44 the latch portion 50 and the second head portion 46 are withdrawn from the latch assembly seat 28 by way of the first enlarged area 30, and the body portion 36, and the spring 58, are withdrawn from the latch seat by way of the second enlarged area 32. The positions of the second head portion 46 and the latch portion 50, on the one hand, and the body portion 36, on the other hand, are exchanged, such that the lock button is on the right side, and the first head portion 38 on the left side, for left hand orientation. The threaded elements 36, 44 are threadedly engaged and the assembly is complete, with the first head portion 38 disposed in the enlarged area 30 of the latch seat 28 and the second head portion 46 disposed in the second enlarged area 32 of the latch seat, and with the detent means 72 in position for engagement with the magazine slot 10.

Thus, the magazine latch assembly may be easily and quickly exchanged between left and right hand orientation.

It is to be understood that the present invention is by no means limited to the particular construction herein disclosed/and or shown in the drawings, but also comprises any modifications or equivalents within the scope of the disclosure.

Having thus described my invention what I claim as new and desire to secure by Letters Patent of the United States is:

1. A reversible magazine latch system for pistols having a grip portion in which there is provided a cavity for a magazine, said system comprising a latch seat disposed in said pistol, a magazine latch assembly adapted for disposition in and retention by said seat, and a magazine adapted to be engaged by said latch assembly, said seat comprising an opening extending through said pistol and adapted to receive said latch assembly at either end of said opening and retain said latch assembly therein, said magazine having two lateral slots, a selected one of said slots being accessible to said latch assembly when said magazine is disposed in said cavity, said magazine latch assembly comprising a body portion having a first head portion on a first end thereof and a chamber therein, a second head portion threadedly connected to said body portion at a second end of said body portion, a latch portion movably disposed in said chamber, and detent means extending from said latch portion and through an opening in said body portion, said detent means being adapted to engage said selected one of said magazine slots.

2. The invention in accordance with claim 1 in which said chamber is defined by said body portion and said second head portion.

3. The invention in accordance with claim 2 in which a shank extends from said latch portion through an opening in said second head portion and has on an end thereof a lock button.

4. The invention in accordance with claim 3 including a spring disposed in said chamber and biasing said button in a direction outward from said latch assembly.

5. The invention in accordance with claim 4 in which said latch portion includes a surface having a contour generally complementary to a forward wall of said magazine but having said detent means extending therefrom for said engagement with said selected one of said magazine slots.

6. The invention in accordance with claim 5 in which said lock button is movable against the bias of said spring in a direction axially of said opening to move said latch portion in said chamber to remove said detent means from said slot, whereby to release said magazine.

* * * * *